US010059548B2

(12) United States Patent
Chen

(10) Patent No.: US 10,059,548 B2
(45) Date of Patent: Aug. 28, 2018

(54) FILM PACKING DEVICE CAPABLE OF REPLACING GEARS

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 486 days.

(21) Appl. No.: 14/729,261

(22) Filed: Jun. 3, 2015

(65) Prior Publication Data

US 2016/0355373 A1 Dec. 8, 2016

(51) Int. Cl.

| | |
|---|---|
| ***B65H 75/30*** | (2006.01) |
| ***B65H 16/00*** | (2006.01) |
| ***B65B 67/08*** | (2006.01) |
| ***B65B 59/04*** | (2006.01) |
| ***B65B 61/02*** | (2006.01) |
| *B65B 11/00* | (2006.01) |

(52) U.S. Cl.

CPC ..... *B65H 16/005* (2013.01); *B65B 59/04* (2013.01); *B65B 61/02* (2013.01); *B65B 67/085* (2013.01); *B65B 2011/002* (2013.01); *B65H 2402/412* (2013.01)

(58) Field of Classification Search

CPC ..... B65H 16/00; B65H 16/005; B65H 75/24; B65H 75/38; B65H 2402/412; B65B 59/04; B65B 61/02; B65B 67/085; B65B 2011/002

See application file for complete search history.

(56) References Cited

U.S. PATENT DOCUMENTS

| | | | | |
|---|---|---|---|---|
| 5,779,179 A * | 7/1998 | Zentmyer | ..... | B65B 67/085 242/423.2 |
| 6,883,298 B2 * | 4/2005 | Gooding | ..... | B65B 67/085 156/574 |
| 6,920,742 B1 * | 7/2005 | Yu Chen | ..... | B65B 67/085 156/574 |
| 7,228,677 B2 * | 6/2007 | Yu Chen | ..... | B65B 67/085 242/570 |
| 8,104,705 B2 * | 1/2012 | Yu Chen | ..... | B65B 67/08 242/405.2 |
| 8,317,124 B2 * | 11/2012 | Yu Chen | ..... | B65B 67/085 242/588.6 |

* cited by examiner

*Primary Examiner* — William A. Rivera
(74) *Attorney, Agent, or Firm* — Ming Chow; Sinorica, LLC

(57) ABSTRACT

A film packing device capable of replacing gears includes a handle. Two ends of the handle are provided with a coupling rod and a base, respectively. A film application unit and a pair of rollers are pivotally connected between the coupling rod and the base. Two ends of each roller are provided with an axle gear, respectively. The outer toothed portions of the axle gears mesh with a drive gear and a reduction gear, respectively. The drive gear meshes with the reduction gear. Through the outer toothed portions of the axle gears to mesh with the drive gear and the reduction gear, the drive gear and the reduction gear can be installed easily. The drive gear and the reduction gear having different numbers of teeth on the outer toothed portions thereof are selective so as to change the gear ratio thereof to provide a different binding force for packing.

4 Claims, 11 Drawing Sheets

FILM PACKING DEVICE CAPABLE OF REPLACING GEARS

BACKGROUND OF THE INVENTION

1. Field of the Invention

The present invention relates to a film packing device, and more particularly to a film packing device capable of replacing gears.

2. Description of the Prior Art

FIG. 1 is a perspective view of a conventional film packing device. FIG. 2 is an exploded view of the conventional film packing device. The conventional film packing device 200 comprises a handle 1. Two ends of the handle 1 are pivotally connected with a film application unit 2. The two ends of the handle 1 are further pivotally connected with a pair of roller units 3. One end of each roll unit 3 is provided with a gear 4. The gears 4 of the pair of roller units 3 mesh with each other. The gears 4 are adapted to enhance the binding force to pack an article for the roller units 3.

Though the film packing device 200 can enhance the binding force to pack an article through the gears 4 fixed to the ends of the roller units 3, the gear ratio of the gears 4 of the film packing device 200 is fixed. The film packing device 200 only provides a specific binding force for packing an article. If the operator needs a different binding force for packing an article, he/she has to prepare for another film packing device with a different gear ratio. This is inconvenient for use. Accordingly, the inventor of the present invention has devoted himself based on his many years of practical experiences to solve these problems.

SUMMARY OF THE INVENTION

The present invention is to provide a film packing device capable of replacing gears. The gears at the ends of a roller unit can be replaced with ease and positioned for engagement. The binding force of the film packing device is selective for the operator to pack an article.

In order to achieve the aforesaid object, the film packing device capable of replacing gears of the present invention comprises a handle and a roller unit. Two ends of the handle extend in the same direction and are provided with a coupling rod and a base, respectively. The coupling rod is provided with a quick-release unit. The base is provided with a limit unit. The quick-release unit and the limit unit are adapted for pivotally connecting with a film application unit. The roller unit is pivotally connected between the base and the coupling rod. The roller unit comprises a first roller and a second roller. Two ends of the first roller are provided with a first gear assembly, respectively. Two ends of the second roller are provided with a second gear assembly, respectively. The first gear assembly meshes with the second gear assembly. The first gear assembly comprises a first axle gear. The first axle gear is fixed to each of the two ends of the first roller. An outer toothed portion of the first axle gear meshes with an inner toothed portion of a drive gear. The second gear assembly comprises a second axle gear. The second axle gear is fixed to each of the two ends of the second roller. An outer toothed portion of the second axle gear meshes with an inner toothed portion of a reduction gear. An outer toothed portion of the reduction gear meshes with an outer toothed portion of the drive gear.

The film packing device capable of replacing gears of the present invention uses the outer toothed portion of the first axle gear to mesh with the inner toothed portion of the drive gear as well as the outer toothed portion of the second axle gear to mesh with the inner toothed portion of the reduction gear, so that the drive gear and the reduction gear can be replaced easily. The outer toothed portion of the first axle gear and the outer toothed portion of the second axle gear mesh with the drive gear and the reduction gear having different numbers of teeth on the outer toothed portions thereof so as to change the gear ratio of the teeth on the first gear assembly and the second gear assembly. In this way, the operator can elect a different binding force for packing the article.

DETAILED DESCRIPTION OF THE PREFERRED EMBODIMENTS

Embodiments of the present invention will now be described, by way of example only, with reference to the accompanying drawings.

Figure 1:
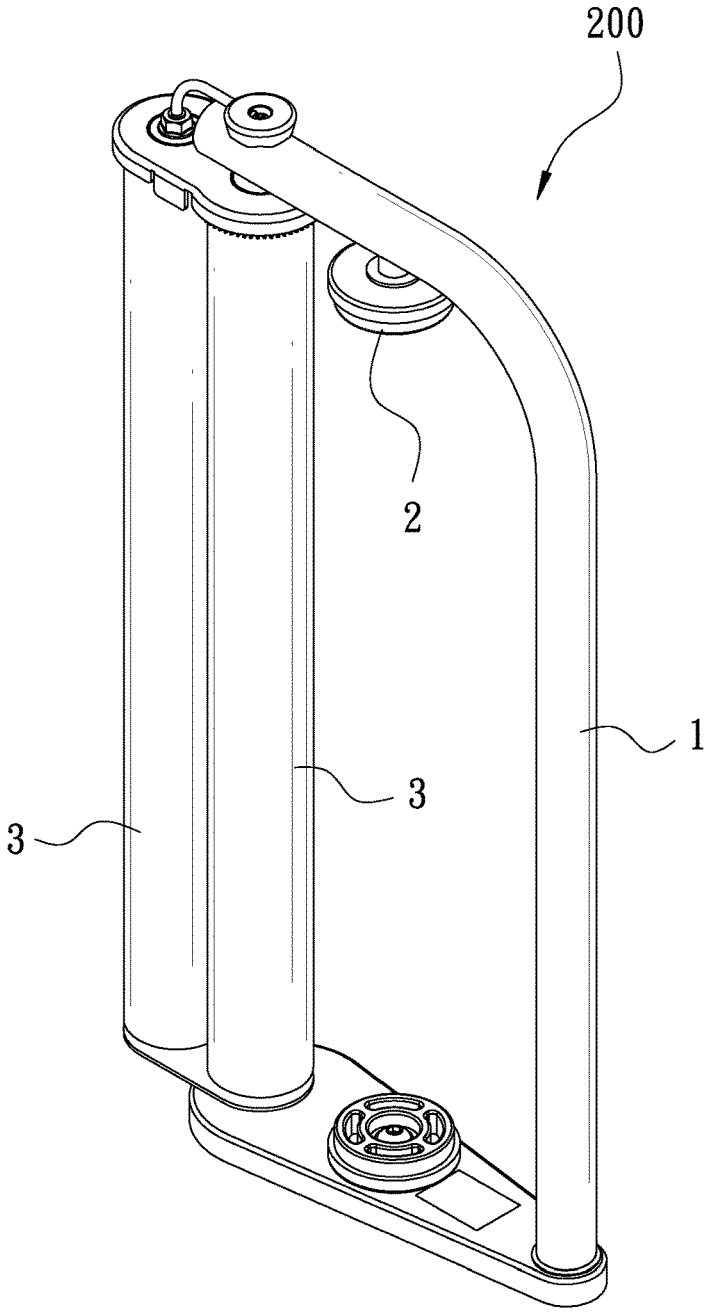
FIG. 1 PRIOR ART
FIG. 1 is a perspective view of a conventional film packing device.
Figure 2:
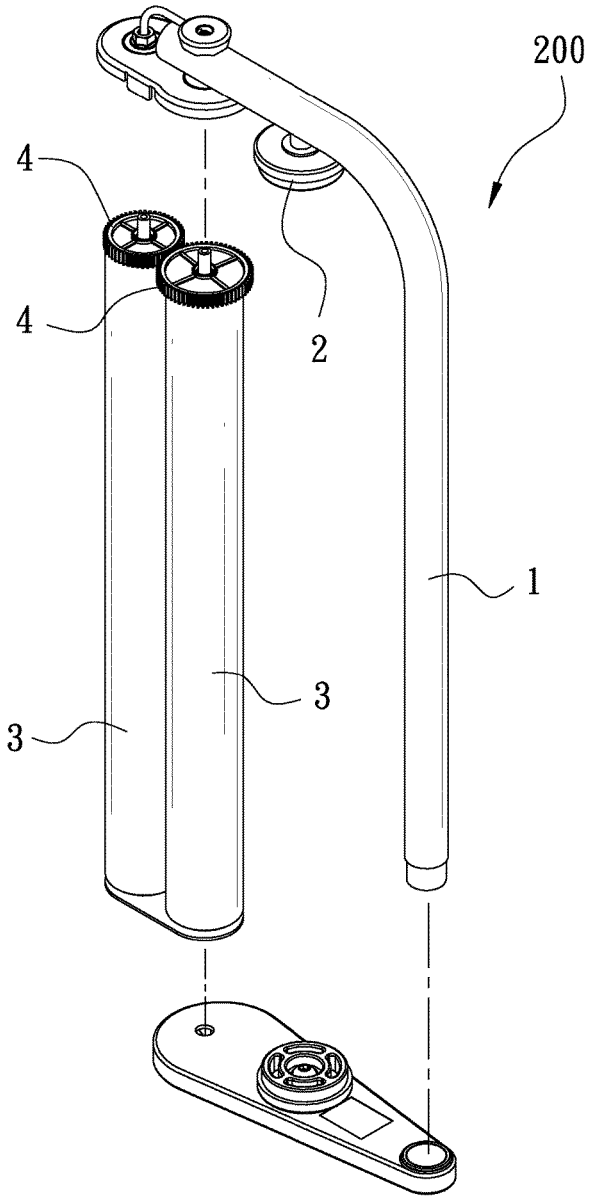
FIG. 2 PRIOR ART
FIG. 2 is an exploded view of the conventional film packing device.
Figure 3:
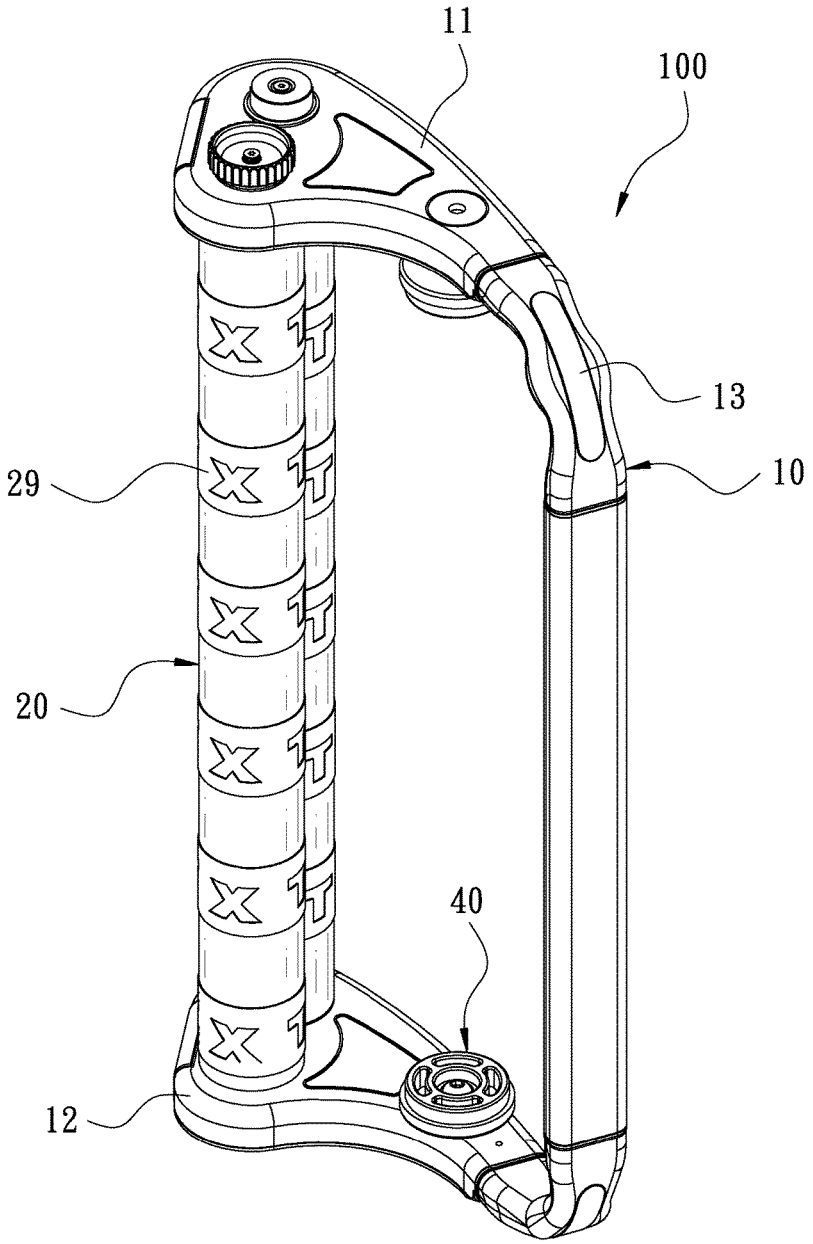
FIG. 3 is a perspective view according to a first embodiment of the present invention.
Figure 4:
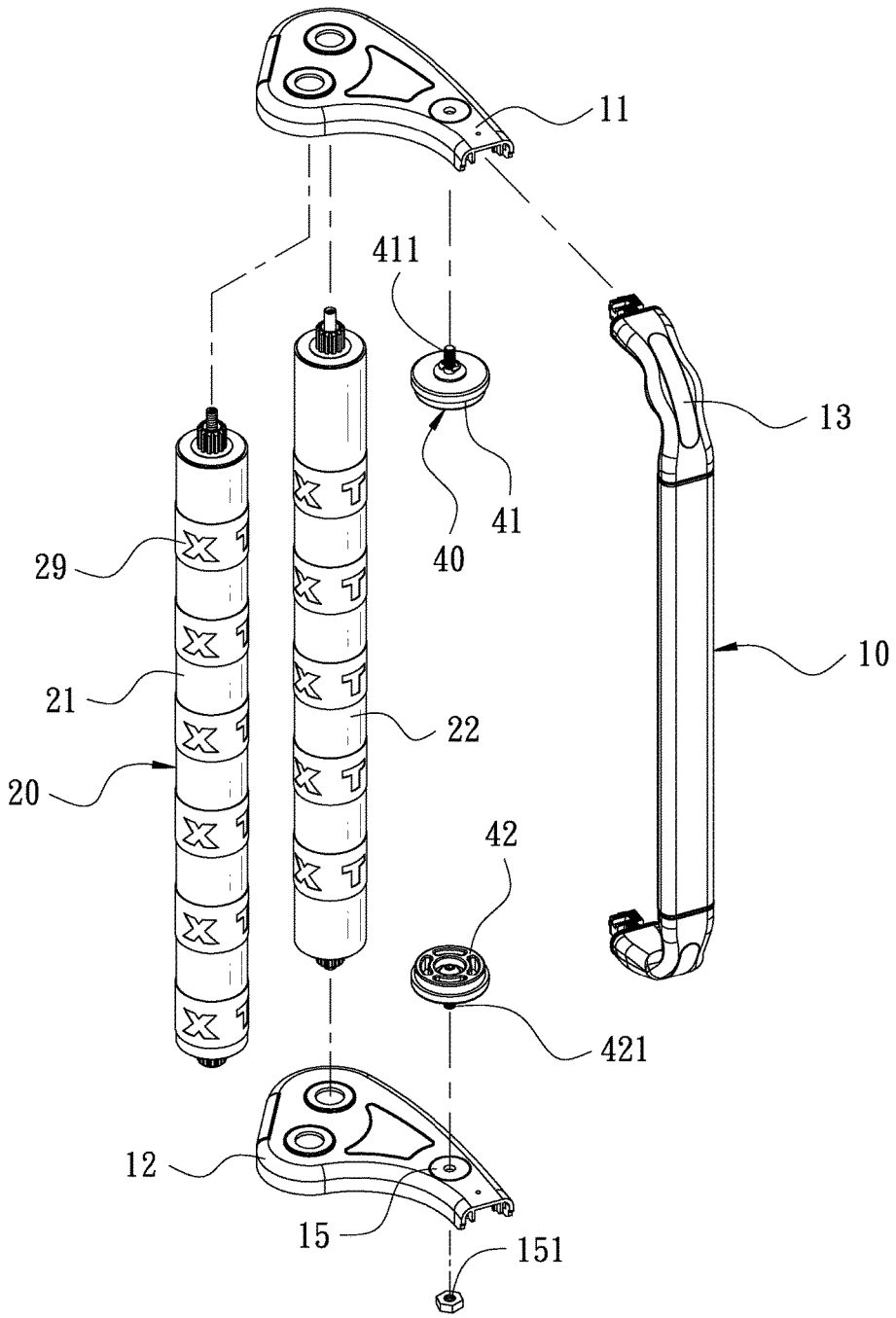
FIG. 4 is an exploded view according to the first embodiment of the present invention.

FIG. 3 is a perspective view according to a first embodiment of the present invention. FIG. 4 is an exploded view according to the first embodiment of the present invention. The present invention discloses a film packing device 100 capable of replacing gears. The film packing device 100 comprises a handle 10, a roller unit 20, and a film application unit 40.

Figure 5:
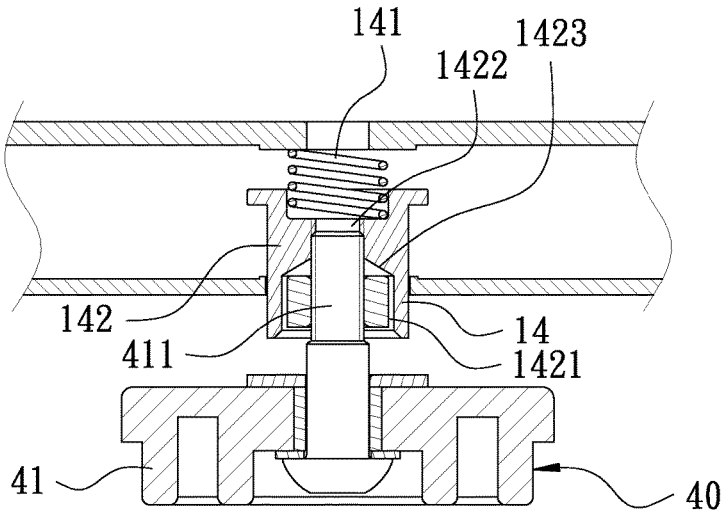
FIG. 5 is a partial sectional view according to the first embodiment of the present invention.
Figure 6:
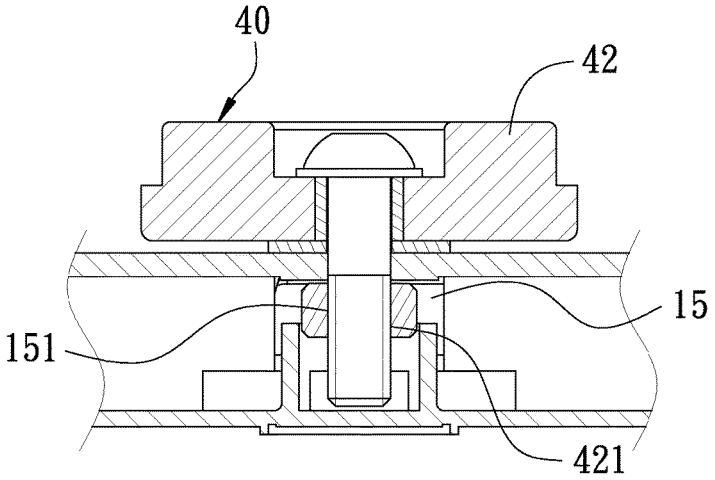
FIG. 6 is a further partial sectional view according to the first embodiment of the present invention.

Two ends of the handle 10 extend in the same direction and are provided with a coupling rod 11 and a base 12, respectively. The handle 10 has a grip 13 between the coupling rod 11 and the base 12. In this embodiment, the handle 10 can be selectively installed with a grip 13 in a different length. In cooperation with FIG. 5 and FIG. 6, the coupling rod 11 is provided with a quick-release unit 14. The quick-release unit 14 comprises an elastic member 141 and a retaining member 142. One end of the elastic member 141 is fixed to the coupling rod 11, and another end of the elastic member 141 elastically holds against the retaining member 142. The retaining member 142 includes a retaining trough 1421. The retaining trough 1421 is formed with a bottom surface 1423. The bottom surface 1423 is an oblique surface.

The bottom surface 1423 is gradually reduced toward its center to form a funnel shape. The center of the bottom surface 1423 of the retaining member 142 is formed with a retaining screw hole. The base 12 is provided with a limit unit 15. The limit unit 15 comprises a limit screw nut disposed in the base 12. The limit screw nut is provided with a limit screw hole 151.

Figure 7:
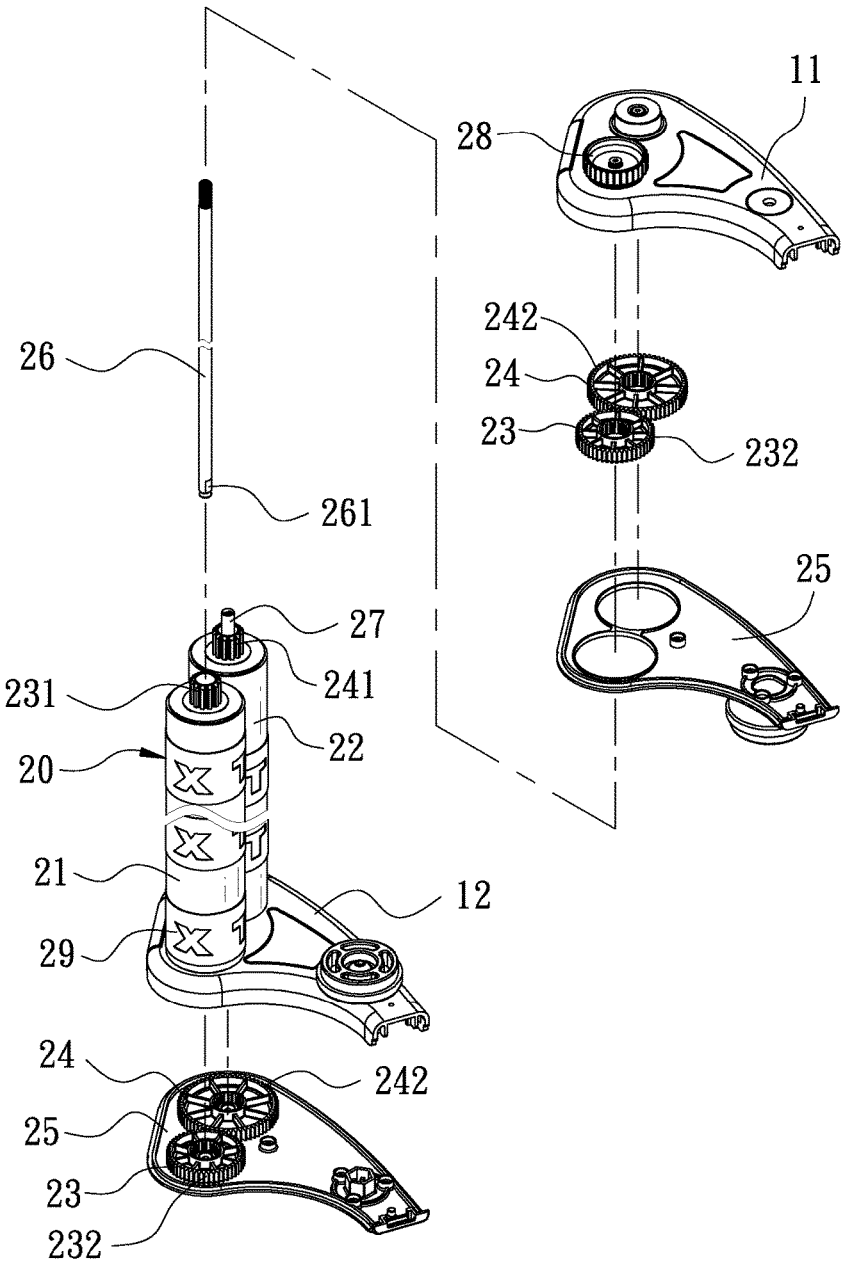
FIG. 7 is an exploded view showing the roller unit according to the first embodiment of the present invention.
Figure 8:
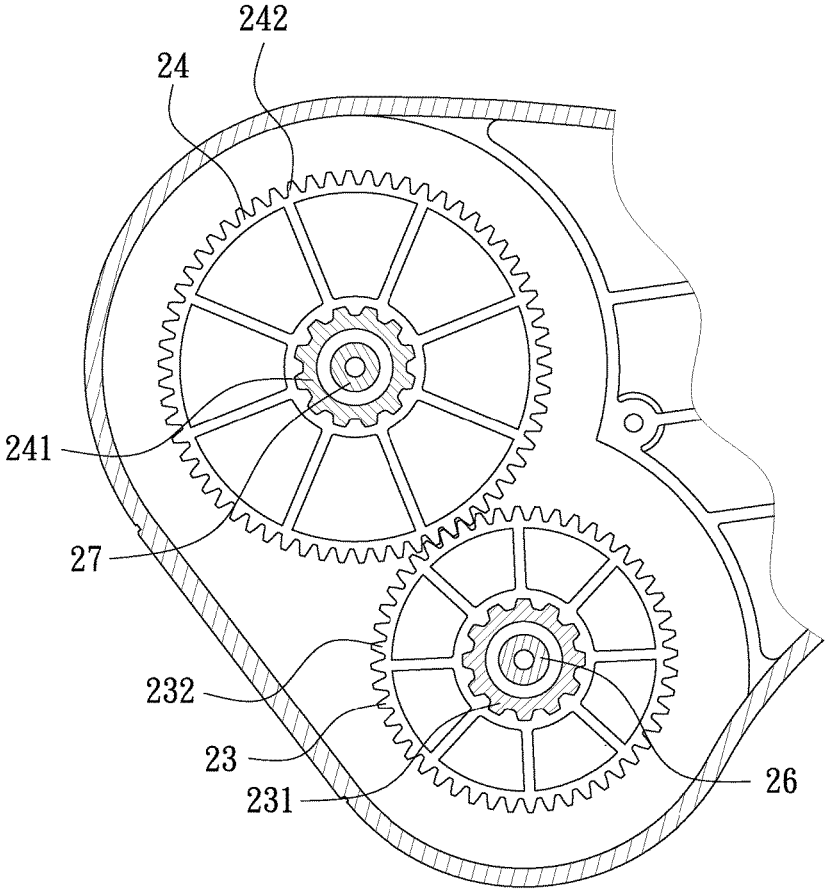
FIG. 8 is a sectional view showing the gear assembly according to the first embodiment of the present invention.

The roller unit 20 is pivotally connected between the base 12 and the coupling rod 11. Referring to FIG. 7 and FIG. 8, the roller unit 20 comprises a first roller 21 and a second roller 22. The first roller 21 and the second roller 22 are disposed side by side. Two ends of the first roller 21 are provided with a first gear assembly 23, respectively. Two ends of the second roller 22 are provided with a second gear assembly 24, respectively. The first gear assembly 23 meshes with the second gear assembly 24. The first gear assembly 23 comprises a first axle gear 231. The first axle gear 231 is fixed to each of the two ends of the first roller 21. An outer toothed portion of the first axle gear 231 meshes with an inner toothed portion of a drive gear 232. The second gear assembly 24 comprises a second axle gear 241. The second axle gear 241 is fixed to each of the two ends of the second roller 22. An outer toothed portion of the second axle gear 241 meshes with an inner toothed portion of a reduction gear 242. An outer toothed portion of the reduction gear 242 meshes with an outer toothed portion of the drive gear 232. The outer toothed portion of the reduction gear 242 has teeth more than those of the outer toothed portion of the drive gear 232. The outer circumference of the first axle gear 231 and the outer circumference of the second axle gear 232 can be selectively fitted with the drive gear 232 and the reduction gear 242 having different numbers of teeth. The gear ratio of the teeth on the reduction gear 242 and the drive gear 232 is in the range of 1.1 to 1.3. In the first embodiment of the present invention, the number of the teeth on the reduction gear 242 is 62. The number of the teeth on the drive gear 232 is 48. This is just an embodiment, and the present invention is not limited to this embodiment. The number of the teeth on the reduction gear 242 and the number of the teeth of the drive gear 232 and their gear ratio can be different. At least one of the outer wall of the first roller 21 and the outer wall of the second roller 22 is provided with a tension judgement member 29. The tension judgement member 29 is a pattern. The pattern is selected from one of a convex pattern and a concave pattern or a combination thereof. The outer sides of the first roller 21 and the second roller 22 are provided with a casing 25, respectively. The roller unit 20 further comprises a first connecting rod 26 and a second connecting rod 27. The first connecting rod 26 and the second connecting rod 27 are disposed in the first roller 21 and the second roller 22, respectively. The first connecting rod 26 and the first roller 21 are coaxial. The second connecting rod 27 and the second roller 22 are coaxial. Two ends of the first connecting rod 26 and the second connecting rod 27 are pivotally connected with the coupling rod 11 and the base 12, respectively. One end of the first connecting rod 26 is provided with an adjustment knob 28 corresponding to the first gear assembly 23. Another end of the first connecting rod 26 is provided with an engaging surface 261, such that the first connecting rod 26 is fixed to the base 12 through the engaging surface 261. Two ends of the second connecting rod 27 are pivotally connected to the coupling rod 11 and the base 12, respectively.

The film application unit 40 comprises a first film seat 41 and a second film seat 42. The first film seat 41 and the second film seat 42 are disposed oppositely. The first film seat 41 comprises a first fixing portion 411 corresponding to the retaining screw hole 1422 of the retaining member 142. The second film seat 42 comprises a second fixing portion 421 corresponding to the limit screw hole 151 of the limit unit 15. Both the first fixing portion 411 and the second fixing portion 421 are screws. The first fixing portion 411 and the second fixing portion 421 are screwed to the retaining screw hole 1422 and the limit screw hole 151 respectively, such that the film application unit 40 is pivotally connected to the coupling rod 11 and the base 12 through the first fixing portion 411 and the second fixing portion 421. In a second embodiment of the present invention, the film application unit 40 further comprises a paper reel between the first film seat 41 and the second film seat 42.

Figure 9:
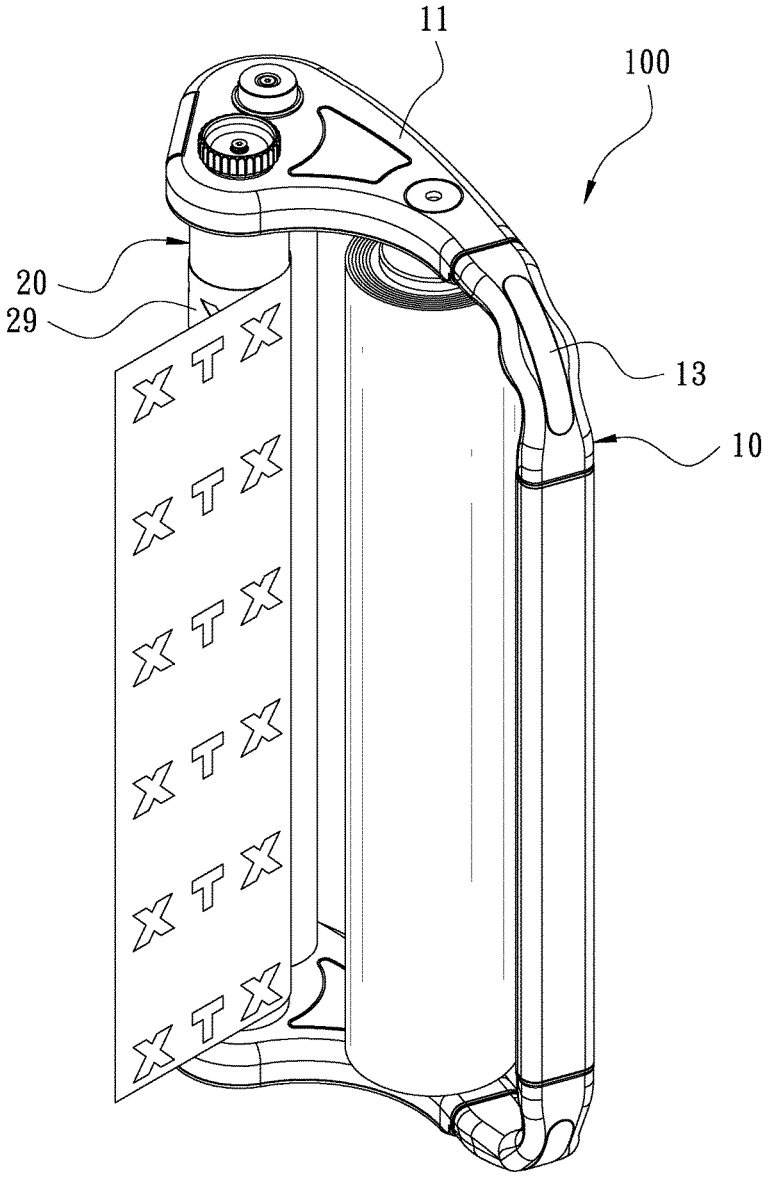
FIG. 9 is a schematic view of the first embodiment of the present invention when in use.

Referring to FIG. 9 in cooperation with FIG. 4 and FIG. 7, when in use, a roll of film having the paper reel is first mounted to the film application unit 40, and then the film is pulled out to pass through the first roller 21 and the second roller 22. After that, the film is attached to an article for packing. Because the roller unit 20 is pivotally connected between the base 12 and the coupling rod 11, the roller unit 20 has larger turning angle and range. In cooperation with the gear ratio of the first gear assembly 23 and the second gear assembly 24, the roller unit 20 can generate larger pulling force and binding force when the operator packs the article. Thus, the present invention can adjust the direction, the pulling force and the tightness of packing as desired, so that the user can pack the article quickly and tightly and adjust the strength of film. In addition, through the roller unit 20, the film packing device can generate even and stable pulling force and binding force for packing the article so that the user can pack the article on the pallet securely.

Figure 10:
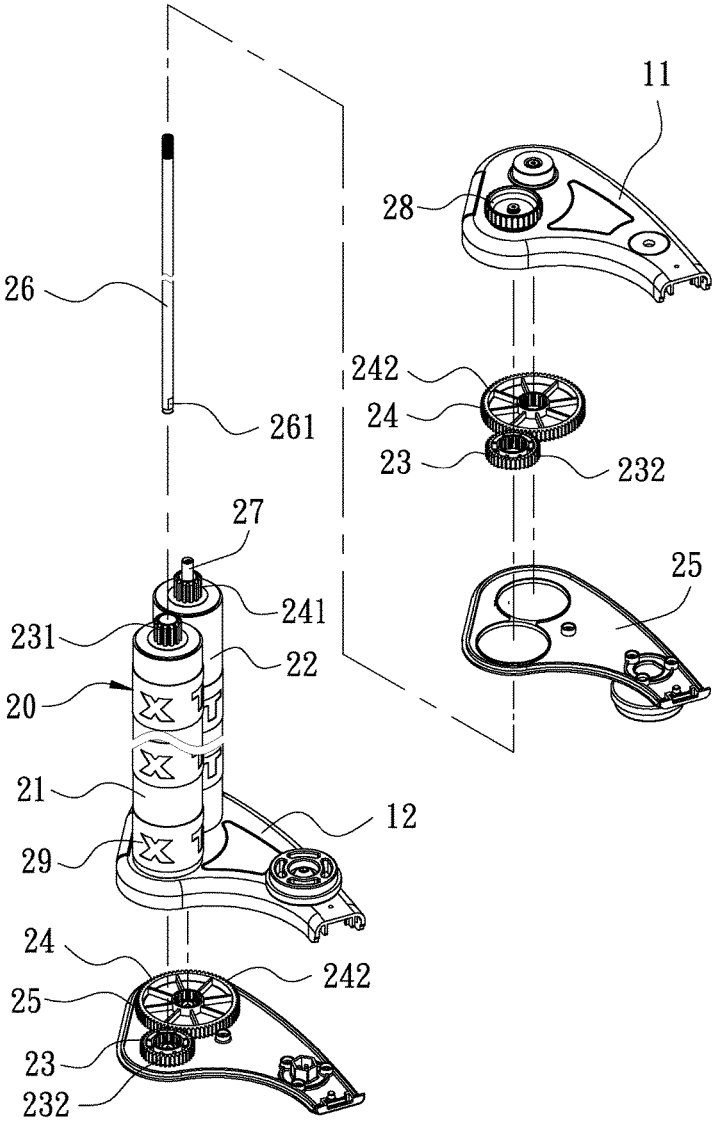
FIG. 10 is an exploded view showing the roller unit according to a second embodiment of the present invention.
Figure 11:
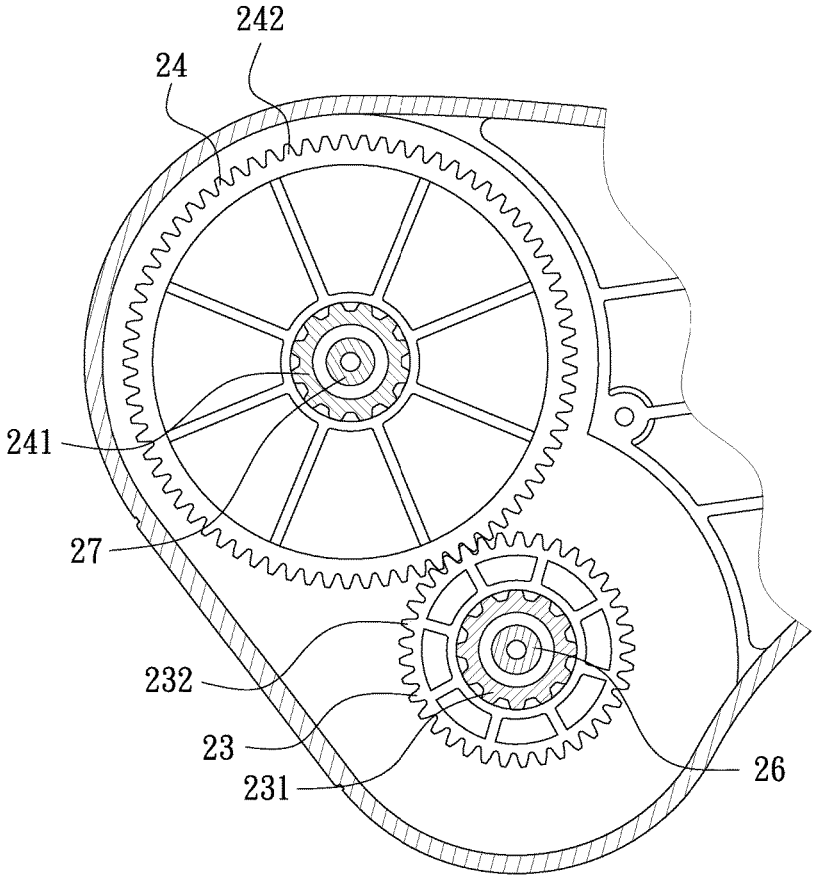
FIG. 11 is a sectional view showing the gear assembly according to the second embodiment of the present invention.

Referring to FIG. 7 and FIG. 8 in cooperation with FIG. 10 and FIG. 11, when the operator wants to adjust the binding force, the pulling force, and the tightness of packing, he/she can change the gear ratio of the first gear assembly 23 and the second gear assembly 24 of the roller unit 20. The casing 25 is first disassembled, and then the outer toothed portion of the first axle gear 231 disengages from the drive gear 232 as well as the outer toothed portion of the second axle gear 241 disengages from the reduction gear 242. The operator can the drive gear 233 and the reduction gear 243 having different numbers of teeth. The drive gear 233 and the reduction gear 243 mesh with the outer toothed portion of the first axle gear 231 and the outer toothed portion of the second axle gear 241, respectively. When the inner toothed portion of the drive gear 233 and the inner toothed portion of the reduction gear 243 mesh with the outer toothed portion of the first axle gear 231 and the outer toothed portion of the second axle gear 241 respectively, the outer toothed portion of the drive gear 233 will mesh with the outer toothed portion of the reduction gear 243. At this time, the installation and positioning engagement of the drive gear 233 and the reduction gear 243 are completed. After that, the casing 25 is assembled. In this way, the replacement of the drive gear 233 and the reduction gear 243 is completed.

FIG. 10 is an exploded view showing the roller unit according to a second embodiment of the present invention. FIG. 11 is a sectional view showing the gear assembly according to the second embodiment of the present invention. In cooperation with FIG. 7 and FIG. 8, the drive gear 233 and the reduction gear 243 of the second embodiment of the present invention have the same inner toothed portions as the drive gear 232 and the reduction gear 242 of the first embodiment of the present invention for the drive gear 233 and the reduction gear 243 to mesh with the outer toothed portions of the first axle gear 231 and the second axle gear 241, respectively. The installation and positioning engagement can be done with ease. The second embodiment is substantially similar to the first embodiment with the exceptions described hereinafter. The number of teeth on the outer toothed portion of the drive gear 233 and the number of teeth on the outer toothed portion of the reduction gear 243 are different from those of the drive gear 232 and the reduction gear 242 of the first embodiment. When the drive gear 233 and the reduction gear 243 mesh with the outer toothed portions of the first axle gear 231 and the second axle gear 241, the first gear assembly 23 and the second gear assembly 24 will form a different gear ratio for the operator to adjust the pulling force and the binding force for packing the article.

Thereby, the film packing device capable of replacing gears can be installed with the drive gears 232, 233 and the reduction gears 242, 243 with ease through the first axle gear 231 and the second axle gear 241, and the replacement and positioning engagement of the drive gears 232, 233 and the reduction gears 242, 243 can be done easily. By using the first axle gear 231 and the second axle gear 241, the drive gears 232, 233 and the reduction gears 242, 243 can be fitted and positioned quickly to form the first gear assembly 23 and the second gear assembly 24. According to the demand of a different film, the drive gear and the reduction gear can be replaced with different ones which have different numbers of teeth on the outer toothed portions thereof so as to change the gear ratio of the teeth on the first gear assembly 23 and the second gear assembly 24 so that the operator can adjust the pulling force and the binding force for packing the article to provide the best application effect.

Figure 12:
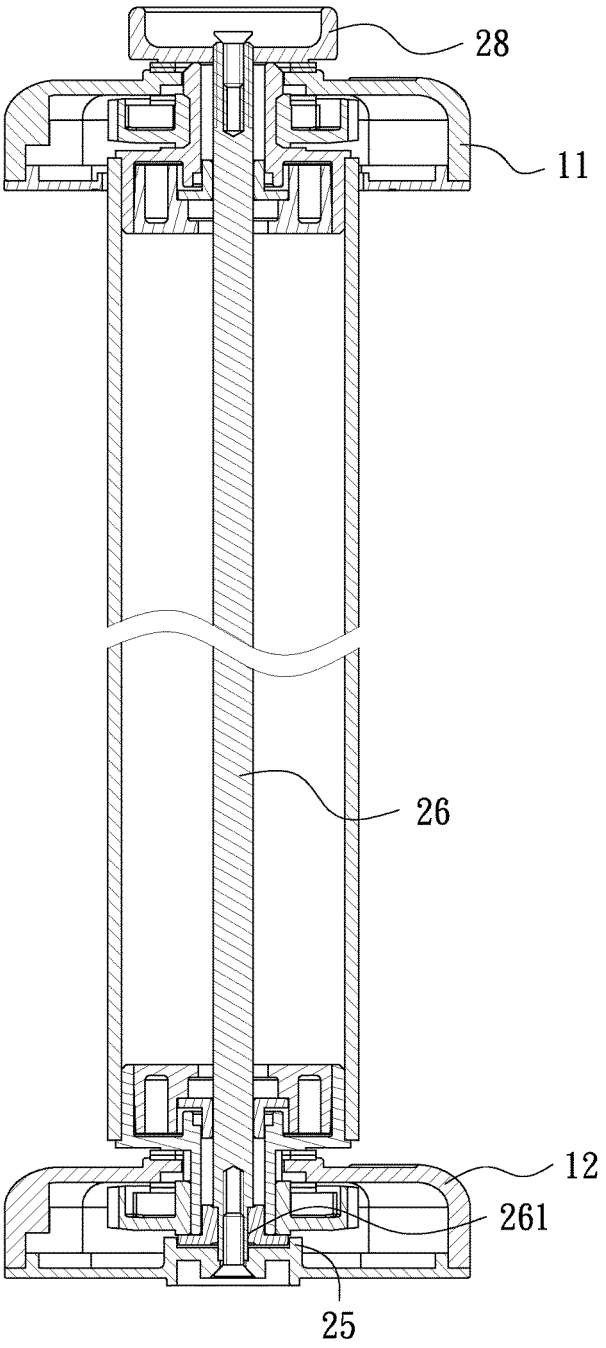
FIG. 12 is a sectional view showing the roller unit according to the second embodiment of the present invention.

Referring to FIG. 12, another end of the first connecting rod 26 is provided with the engaging surface 261 for the end of the first connecting rod 26 to be secured to the base 12. The user can turn the adjustment knob 28 at one end of the first connecting rod 26 to tighten the first connecting rod 26 so as to slightly adjust the tension of the film.

Referring to FIG. 9 in cooperation with FIG. 3, the present invention is provided with the tension judgement member 29. The tension judgement member 29 is a pattern. The pattern is selected from one of a convex pattern and a concave pattern or a combination thereof. When the film passes through the tension judgement member 29, the pattern is transferred to the film. Thus, the user can judge the tension of the film through the size of the deformed pattern after the film is pulled to extend.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A film packing device comprising:

a handle;

the handle comprising an upper handle end, a lower handle end, a coupling rod, a base, an upper casing and a lower casing;

the upper handle end and the lower handle end extending in the same direction;

the coupling rod being provided on the upper handle end;

the base being provided on the lower handle end;

the upper casing being detachably connected with the coupling rod;

the lower casing being detachably connected with the base;

a film application unit;

the film application unit being pivotally connected with the coupling rod and the base;

a roller unit;

the roller unit being pivotally connected in between the base and the coupling rod;

the roller unit comprising a first roller and a second roller;

the first roller comprising a first upper roller end, a first lower roller end, a first upper gear assembly and a first lower gear assembly;

the first upper gear assembly being disposed on the first upper roller end;

the first lower gear assembly being disposed on the first lower roller end;

the first upper gear assembly and the first lower gear assembly being identical to each other;

the second roller comprising a second upper roller end, a second lower roller end, a second upper gear assembly and a second lower gear assembly;

the second upper gear assembly being disposed on the second upper roller end;

the second lower gear assembly being disposed on the second lower roller end;

the second upper gear assembly and the second lower gear assembly being identical to each other;

the first upper gear assembly and the second upper gear assembly meshing with each other;

the first lower gear assembly and the second lower gear assembly meshing with each other;

the first upper gear assembly and the second upper gear assembly being accommodated in between the upper casing and the coupling rod;

the first lower gear assembly and the second lower gear assembly being accommodated in between the lower casing and the base;

the first upper gear assembly comprising a first upper axle gear and a first upper drive gear;

the first lower gear assembly comprising a first lower axle gear and a first lower drive gear;

the second upper gear assembly comprising a second upper axle gear and a second upper reduction gear;

the second lower gear assembly comprising a second lower axle gear and a second lower reduction gear;

the first upper axle gear being fixed to the first upper roller end;

the first lower axle gear being fixed to the first lower roller end;

the second upper axle gear being fixed to the second upper roller end;

the second lower axle gear being fixed to the second lower roller end;

an outer toothed portion of the first upper axle gear meshing with an inner toothed portion of the first upper drive gear;

an outer toothed portion of the first lower axle gear meshing with an inner toothed portion of the first lower drive gear;

an outer toothed portion of the second upper axle gear meshing with an inner toothed portion of the second upper reduction gear;

an outer toothed portion of the second lower axle gear meshing with an inner toothed portion of the second lower reduction gear;

the outer toothed portion of the second upper reduction gear meshing with the outer toothed portion of the first upper drive gear;

the outer toothed portion of the second lower reduction gear meshing with the outer toothed portion of the first lower drive gear;

numbers of teeth on the outer toothed portion of the second upper reduction gear being different from numbers of teeth on the outer toothed portion of the first upper drive gear; and numbers of teeth on the outer toothed portion of the second lower reduction gear being different from numbers of teeth on the outer toothed portion of the first lower drive gear.

2. The film packing device as claimed in claim 1 comprising:

the roller unit comprising a first connecting rod, a second connecting rod and an adjustment knob;

the first connecting rod being inserted in the first roller;

the second connecting rod being inserted in the second roller;

the first connecting rod and the first roller being coaxial with each other;

the second connecting rod and the second roller being coaxial with each other;

the first connecting rod comprising a first upper rod end and a first lower rod end;

the first upper rod end being connected with the adjustment knob;

the first lower rod end being engaged with the base;

the second connecting rod comprising a second upper rod end and a second lower rod end;

the second upper rod end being pivotally connected to the coupling rod; and the second lower rod end being pivotally connected to the base.

3. The film packing device as claimed in claim 1 comprising:

the numbers of the teeth on the outer toothed portion of the second upper reduction gear being larger than the numbers of the teeth on the outer toothed portion of the first upper drive gear;

the numbers of the teeth on the outer toothed portion of the second lower reduction gear being larger than the numbers of the teeth on the outer toothed portion of the first lower drive gear;

the upper gear ratio of the first upper gear assembly and the second upper gear assembly being in the range of 1.1 to 1.3; and the lower gear ratio of the first lower gear assembly and the second lower gear assembly being in the range of 1.1 to 1.3.

4. The film packing device as claimed in claim 1 comprising:

the first roller comprising a first outer wall;

the second roller comprising a second outer wall;

a pattern transferring member;

the pattern transferring member being provided on at least one of the first outer wall and the second outer wall;

the pattern transferring member comprising a pattern; and the pattern being selected from the group consisting of a convex pattern and a concave pattern.

* * * * *